US005551935A

United States Patent [19]

Pustaver et al.

[11] Patent Number: 5,551,935

[45] Date of Patent: Sep. 3, 1996

[54] EXERCISE DEVICE FOR THE LOWER BACK

[75] Inventors: Mark R. Pustaver, Matthews, N.C.; David A. Shmukler, Aliso Viejo, Calif.; Lewis S. Winter, III, Chesterfield, Mo.

[73] Assignee: QL, Inc., Matthews, N.C.

[21] Appl. No.: 345,260

[22] Filed: Oct. 28, 1994

[51] Int. Cl.[6] ..... A63B 23/04

[52] U.S. Cl. ..... 482/142; 482/140; 482/907

[58] Field of Search ..... 5/630, 632; 297/466, 297/423.41; 482/142, 140, 907, 145, 144; D21/191; 606/240, 244

[56] References Cited

U.S. PATENT DOCUMENTS

| | | | |
|---|---|---|---|
| D. 320,824 | 10/1991 | Cordon | D21/191 |
| 2,240,228 | 4/1941 | Schall | 482/145 |
| 4,838,249 | 6/1989 | Jannotta | 128/25 R |
| 4,903,412 | 2/1990 | Pedrow | 33/152 |
| 4,953,857 | 9/1990 | Lemise | 482/142 |
| 5,120,052 | 6/1992 | Evans | 482/145 |
| 5,160,306 | 11/1992 | Lui | 482/140 |
| 5,217,487 | 6/1993 | Engel et al. | 482/142 |

*Primary Examiner*—Stephen R. Crow
*Assistant Examiner*—Jerome Donnelly
*Attorney, Agent, or Firm*—W. Thad Adams, III, P.A.

[57] ABSTRACT

An exercise device is provided for strengthening the lower back of a user. The exercise device includes a base for being located on a supporting surface. An inclined surface is supported by the base for engaging the thighs of the user to support at an angle a portion of the body extending generally from the waist to the knees. The upper body of the user extends over a front edge of the inclined surface for exercising movement between a flexed position and an extended position. A stabilizer bar is connected to the exercise device for engaging and holding the legs of the user against the inclined surface when exercising.

9 Claims, 5 Drawing Sheets

EXERCISE DEVICE FOR THE LOWER BACK

TECHNICAL FIELD AND BACKGROUND OF THE INVENTION

This invention relates to an exercise device for the strengthening the muscles of the lower back. The invention is relatively light-weight, and conveniently storable and transportable for use when traveling. Moreover, unlike many prior art exercise machines and devices, the present invention is relatively inexpensive to manufacture. The low cost will make the invention readily available for purchase, and will encourage home use by persons without the time or resources to go to a gym, and others who may be intimidated by the gym atmosphere.

Studies show that approximately 70–80 percent of all adults will experience low back pain at some time in their lives, with as much as 50 percent being affected each year. Back pain is one of the most expensive medical problem in the United States, and the most frequent cause of activity limitation among persons under age 45. It is estimated that the total cost attributed to the treatment of low back disorders in 1990 was $50–100 billion.

The most effective means of rehabilitation and injury prevention for the lower back is exercise. According to fitness experts, exercises using body weight or strength training machines to provide back-strengthening resistance are less likely to cause injury or aggravate low back problems than free weights. Strength training machines, such as that manufactured by Nautilus, may cost several thousands of dollars, and generally require trained supervision during use. As a result, many persons who are not members of a fitness center simply do not exercise the muscles of the low back. These persons become more susceptible to minor low back pain, and potential serious injury.

The present invention provides an exercise device for the low back which is relatively inexpensive, and especially applicable for home use. The invention is usable by persons of all ages and builds.

SUMMARY OF THE INVENTION

Therefore, it is an object of the invention to provide an exercise device for strengthening the muscles of the lower back.

It is another object of the invention to provide an exercise device which is relatively inexpensive to manufacture.

It is another object of the invention to provide an exercise device which is relatively light weight, and conveniently stored and transported.

It is another object of the invention to provide an exercise device which utilizes the body weight of the user.

It is another object of the invention to provide an exercise device which is easy to use.

It is another object of the invention to provide an exercise device for the lower back which limits the range of movement of the upper body to a maximum angle of about 40–50 degrees relative to the plane of the inclined surface of the device.

These and other objects of the present invention are achieved in the preferred embodiments disclosed below by providing an exercise device for strengthening the lower back of a user. The exercise device includes a base for being located on a supporting surface. An inclined surface is supported by the base for engaging the thighs of the user to support at an angle a portion of the body extending generally from the waist to the knees. The upper body of the user extends over a front edge of the inclined surface for exercising movement between a flexed position and an extended position. Stabilizer means is connected to the exercise device for engaging and holding the legs of the user against the inclined surface when exercising.

According to one preferred embodiment of the invention, a declined surface is supported by the base, and extends downwardly at an angle from the front edge of the inclined surface towards the supporting surface. The declined surface engages the upper body of the user when the upper body is in the flexed position.

According to another preferred embodiment of the invention, the stabilizer means includes a stabilizer bar for engaging the back of the legs of the user to hold the legs against the inclined surface of the exercise device.

According to yet another preferred embodiment of the invention, the stabilizer means further includes an adjustable strap for interconnecting the stabilizer bar and the exercise device. The strap is lengthened or shortened by the user for adjusting the position of the stabilizer bar relative to the inclined surface to accommodate the height of the particular user.

Preferably, an opening is formed in a back end of the exercise device for receiving an attachment cup. The cup includes a rigid shaft for attaching the adjustable strap of the stabilizer means to the exercise device.

According to another preferred embodiment of the invention, the stabilizer means includes a nylon belt for extending around and holding the legs of the user against the inclined surface of the exercise device.

According to yet another preferred embodiment of the invention, a recess is formed in the inclined surface for protecting the groin area of the user during exercising.

Preferably, a protective pad is located adjacent to the recess for cushioning the groin area of the user during exercising.

Preferably, the exercise device is constructed of a light-weight, resilient foam material.

According to one preferred embodiment of the invention, the foam material is polyethylene.

According to another preferred embodiment of the invention, the foam material is polystyrene.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
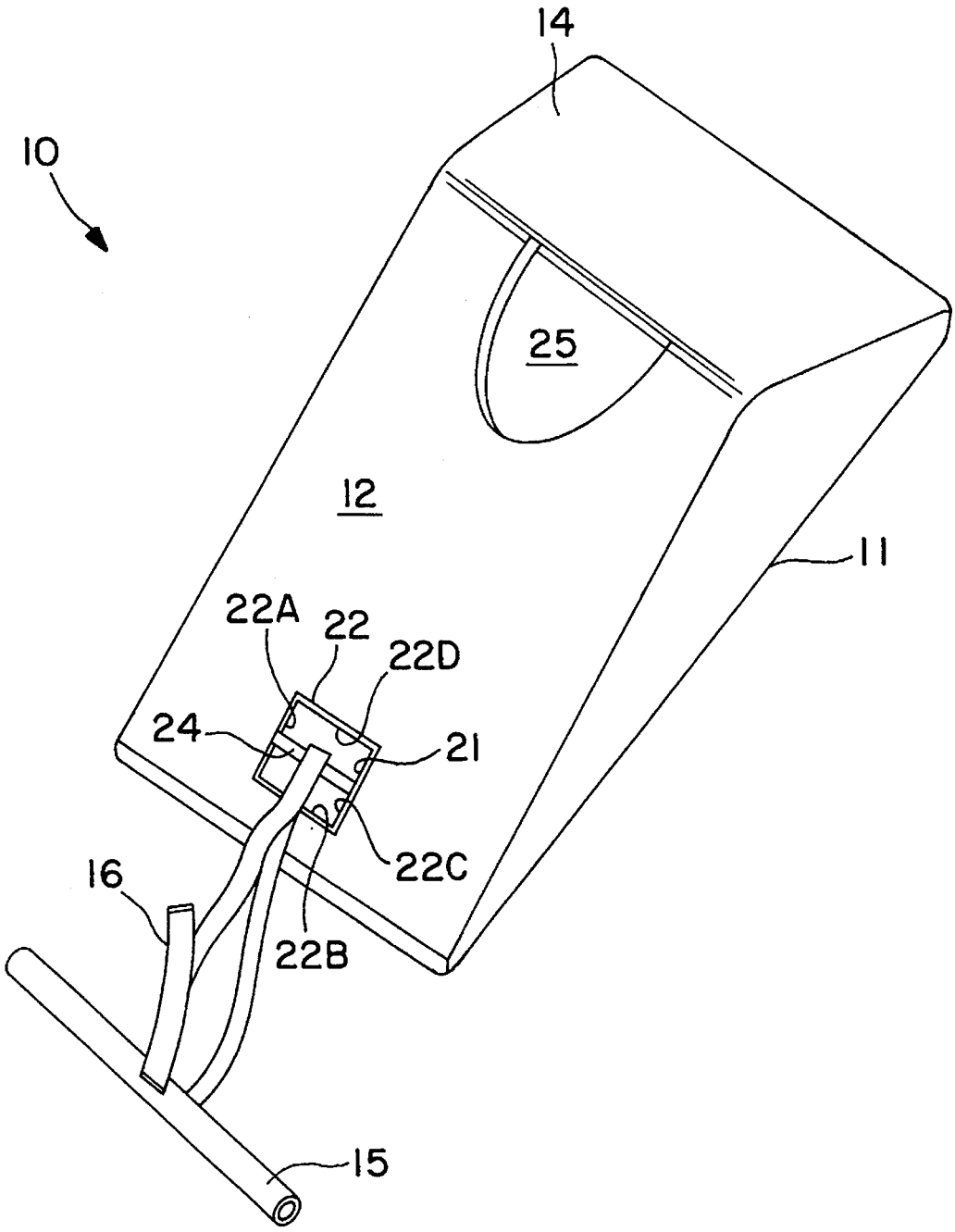
FIG. 1 is a perspective view of the exercise device according to a preferred embodiment of the invention.

Referring now specifically to the drawings, an exercise device according to the present invention is illustrated in FIG. 1 and shown generally at reference numeral 10. The exercise device 10 is used for strengthening the muscles of the lower back, and is applicable to persons of all ages and builds. Preferably, the exercise device 10 weighs between 3 and 5 lbs., and is constructed of a molded polyethylene or polystyrene foam material.

Figure 2:
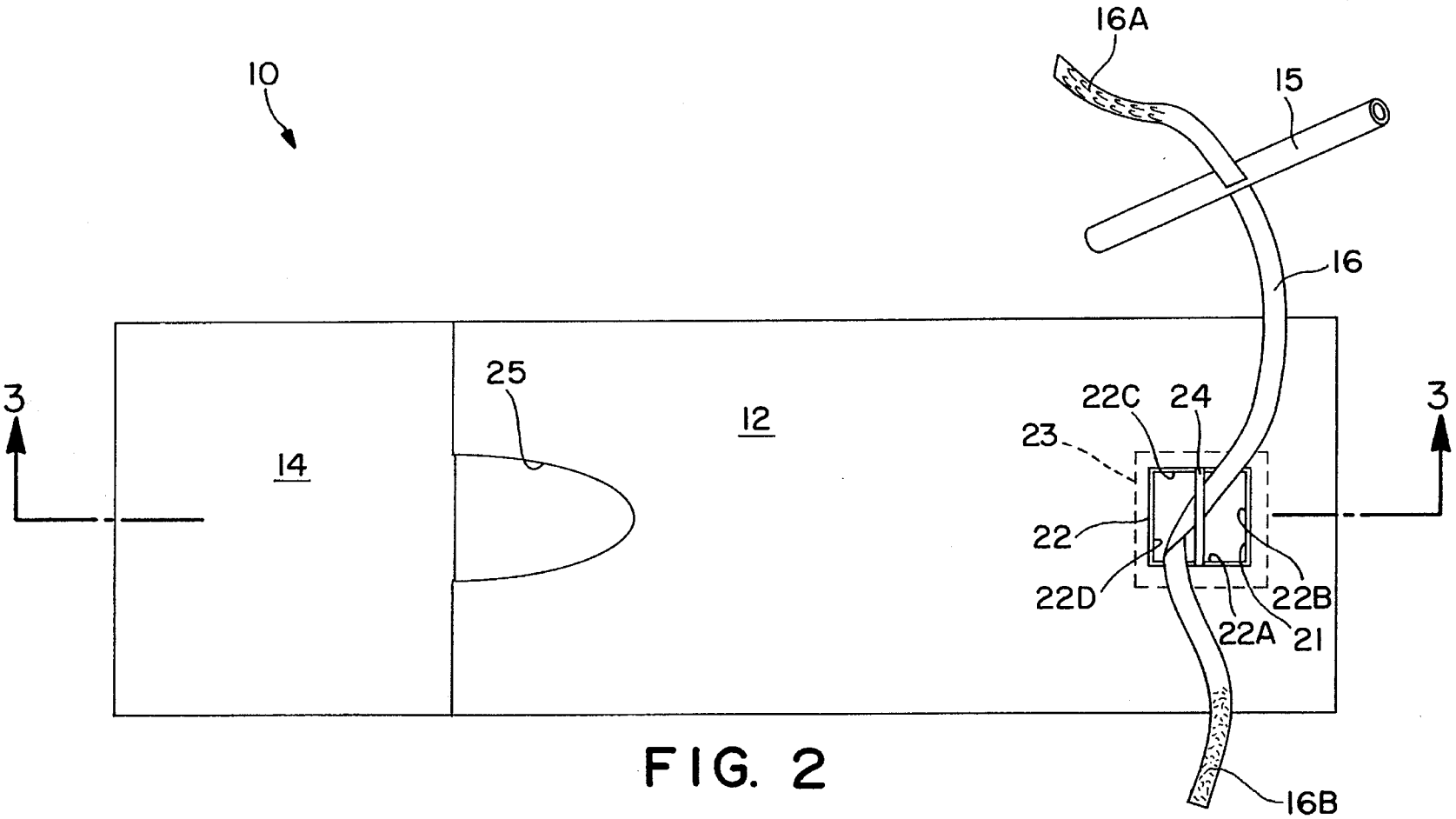
FIG. 2 is a top plan view of the exercise device, and showing the free ends of the strap separated for length adjustment.
Figure 3:
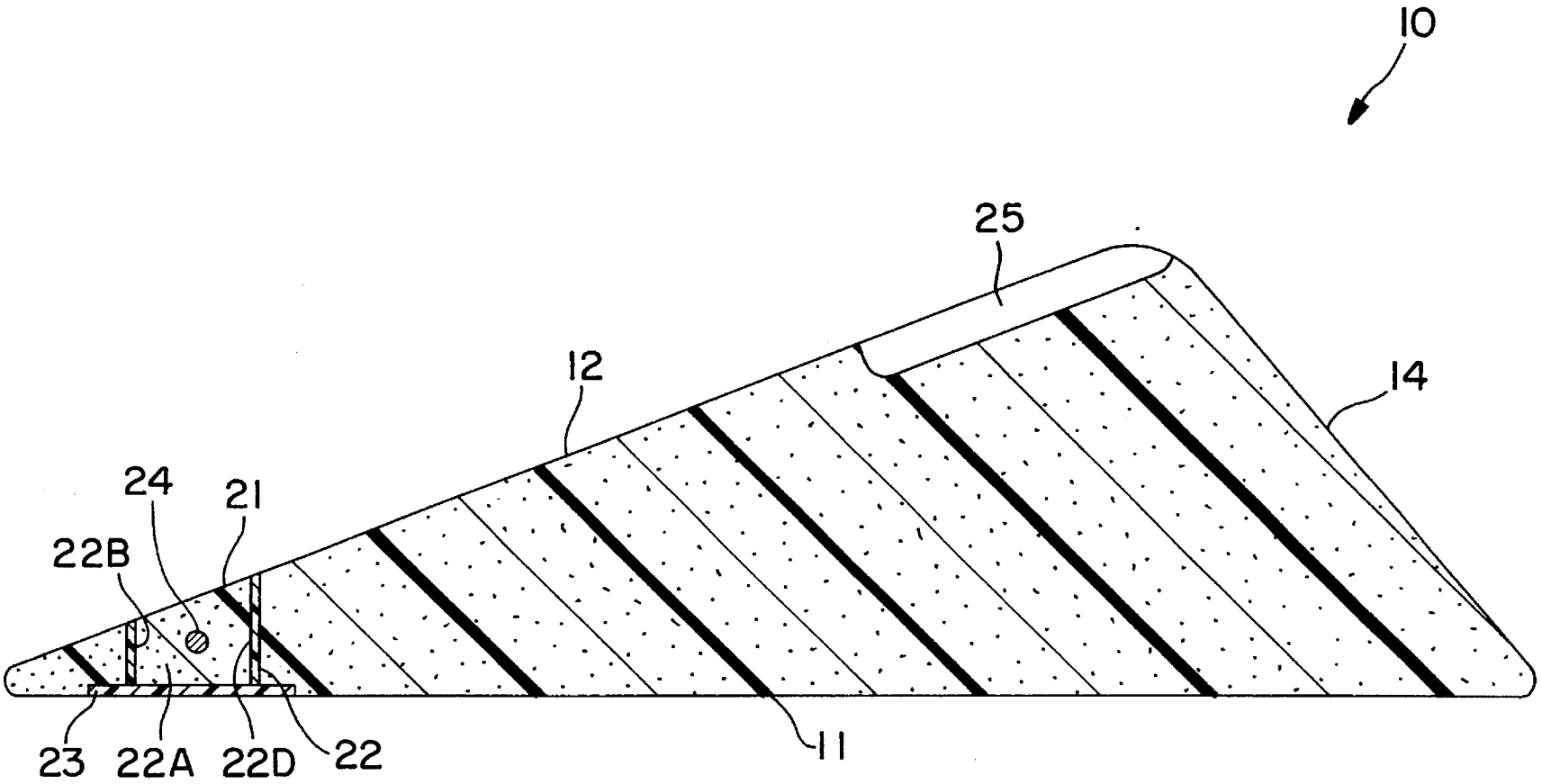
FIG. 3 is a cross-sectional side view of the exercise device taken substantially along lines 3—3 of FIG. 2 with the strap and stabilizer bar removed.

As shown in FIGS. 1–3, the exercise device 10 includes a base 11 for being positioned on a floor surface, and an inclined surface 12 for supporting at an angle a portion of the body extending generally from the waist to the knees of the user. Preferably, the angle of the inclined surface 12 is between 45 and 60 degrees relative to the floor surface. To obtain a greater or lesser angle, one or more shims (not shown) may be placed under either end of the exercise device 10.

The upper body of the user extends over the front edge of the inclined surface 12, and is moved between a flexed position and an extended position to exercise the low back, as described below. The "upper body" is defined herein as the portion of the body extending generally from the waist to the head of the user.

Figure 4:
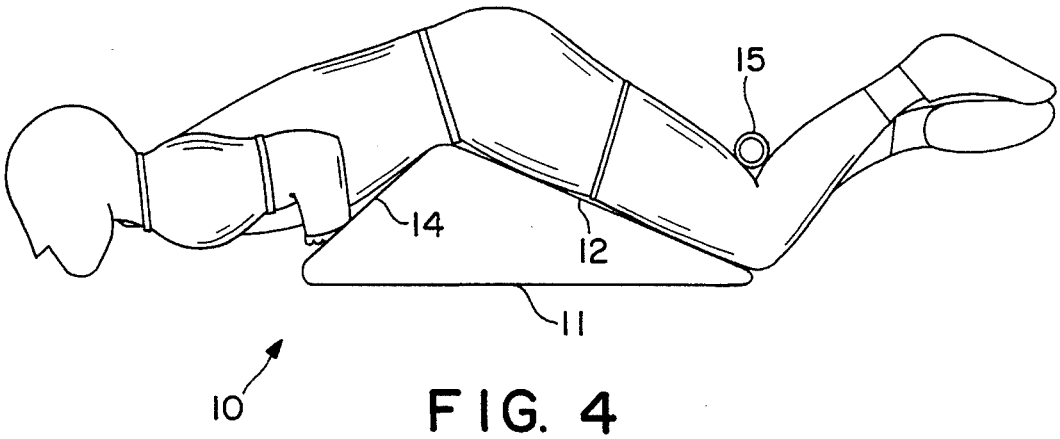
FIG. 4 is a side elevational view of the exercise device with a user in the flexed position.

The exercise device 10 further includes a declined surface 14 extending downwardly from the front edge of the inclined surface 12 for limiting the range of movement of the user, and for supporting the upper body when in the flexed position shown in FIG. 4. The declined surface 14 further acts to stabilize the exercise device 10, and to prevent the exercise device 10 from tilting forward during use. The angle of declined surface 14 is preferably between 120 and 140 degrees relative to the plane of the base 11.

In the flexed position, the angle of the upper body relative to the plane of the inclined surface 12 is about 40–50 degrees. Movement beyond 70 degrees will hinder effective exercising of the back muscles, and may cause injury or strain to the ligaments of the lower back.

A stabilizer bar 15 is located at a back end of the exercise device 10 for holding the legs of the user against the inclined surface 12 when exercising. When the user is properly positioned on the exercise device 10, the bar 15 resides against the back of the knees, as shown in FIGS. 4 and 5, and the upper body of the user extends over the front edge of inclined surface 12, as discussed above.

Preferably, an adjustable strap 16 interconnects the bar 15 and the exercise device 10. According to one embodiment, opposing free ends of the strap 16 are releasably attached together by means of complementary hook and loop sections 16A and 16B, such as "Velcro", or a buckle attachment commonly known and used in the art. The strap 16 is easily adjusted by the user to be lengthened or shortened as desired. For example, a relatively tall user would need less length to locate the stabilizer bar 15 against the back of the knees when properly positioned on the exercise device 10, whereas a relatively short user would need a longer strap 16.

An opening 21 is preferably formed at the back end of the inclined surface 12 for receiving an attachment cup 22. As is best shown in FIGS. 1, 2, and 3, the attachment cup 22 includes side walls 22A, 22B, 22C, and 22D located within the opening 21, and dimensioned to extend flush with the slope of the inclined surface 12. A rigid shaft 24 is located within the cup 22, and molded to the side walls 22A and 22C to provide means for anchoring the strap 16 to the exercise device 10. A bottom wall 23 of the cup 22 is connected to each of the side walls 22A–22D, and is larger than the opening 21 to prevent the cup 22 from pulling upwardly through the exercise device 10 during use. Preferably, the bottom wall 23 is flush with the plane of the base 11, as shown in FIG. 3.

Figure 5:
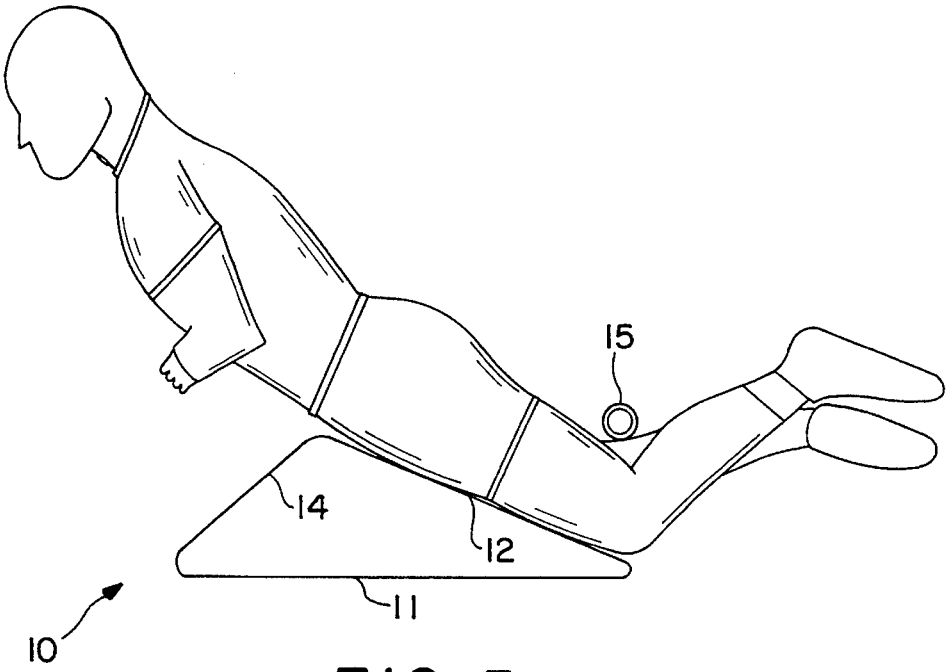
FIG. 5 is a side elevational view of the exercise device with a user in the extended position.

FIGS. 4 and 5 demonstrate the proper technique for using the exercise device 10 to strengthen the lower back. The user mounts the exercise device 10, and locates the stabilizer bar 15 against the back of the knees, as shown in FIG. 4. With a slow and controlled movement, the user lifts the upper body off the declined surface 14 to the extended position shown in FIG. 5. The user pauses for two or three seconds at the extended position, and then slowly lowers the upper body back to the flexed position shown in FIG. 4. For beginner users, the hands may be placed on the floor surface, and the strength of the arms used to help control the movement between the flexed and extended positions.

As best shown in FIGS. 1–3, the exercise device 10 further includes a groin-protective recess 25 formed at the front edge of the inclined surface 12 for protecting the groin area of the user when exercising. The inclined surface 12 may also include soft padding surrounding the groin-protective recess 25 for added comfort.

Figure 6:
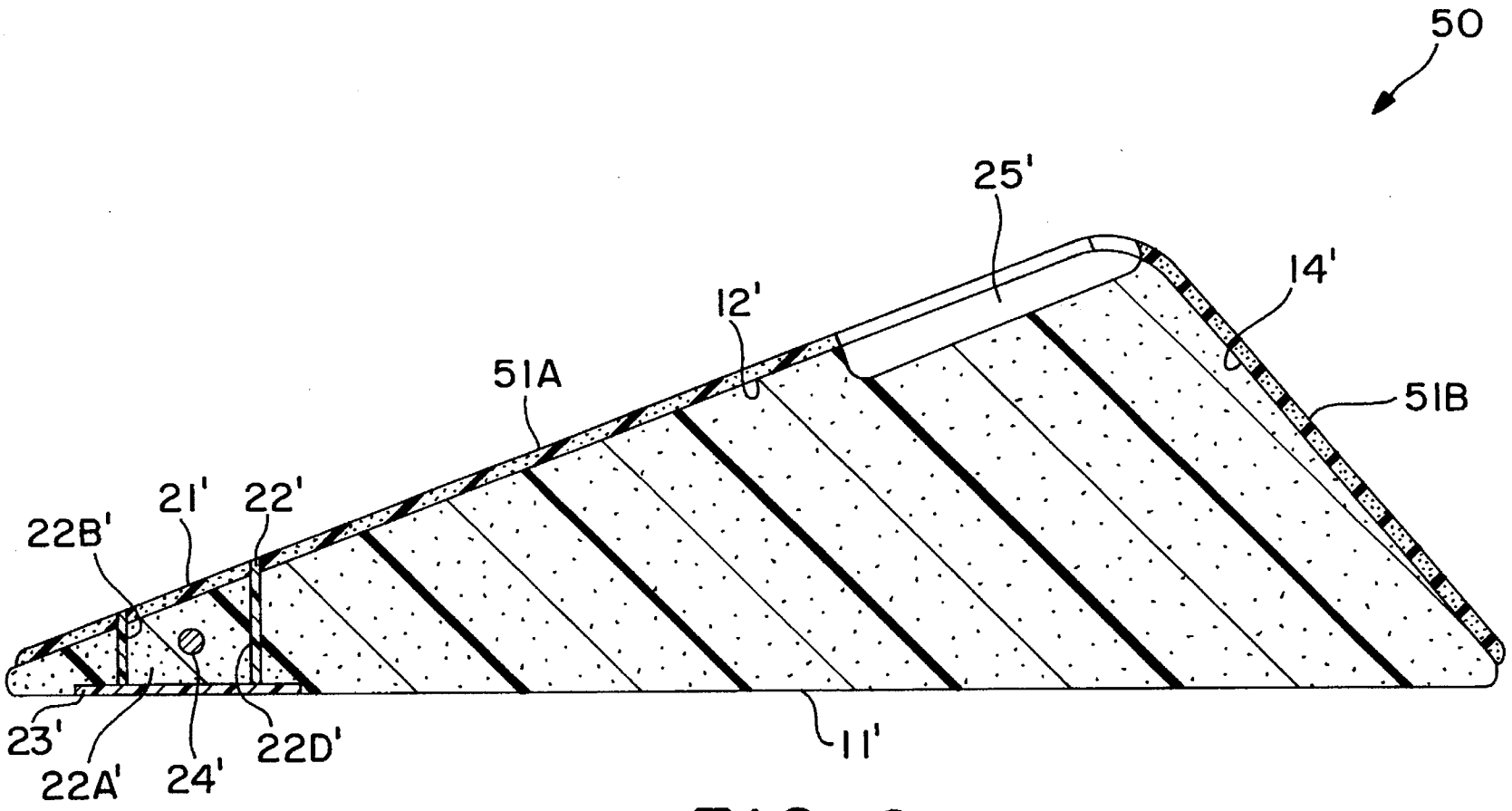
FIG. 6 is a cross-sectional side view of the exercise device according to a second embodiment of the invention with the strap and stabilizer bar removed.

A second embodiment of the exercise device 50 is illustrated in FIG. 6. Like elements described above are indicated in prime notation. As shown, the exercise device 50 includes top layers 51A and 51B of soft foam padding located, respectively, over the entire surface area of the inclined surface 12' and the declined surface 14'.

In a further embodiment (not shown), the exercise device does not include a stabilizer bar. Rather, a strap, such as that described above, is attached to the exercise device and secured directly around the legs of the user to hold the legs against the inclined surface when exercising.

An exercise device 10 for the lower back is described above. Various details of the invention may be changed without departing from its scope. Furthermore, the foregoing description of the preferred embodiment of the invention is provided for the purpose of illustration only and not for the purpose of limitation— the invention being defined by the claims.

We claim:

1. An exercise device for strengthening the lower back of a user, comprising:

(a) a base for being located on a supporting surface;

(b) an inclined surface supported by the base and defining a relatively long, gradual incline for engaging the thighs of the user to support at an angle a portion of the body extending generally from the waist to the knees, whereby the upper body of the user extends over a front edge of the inclined surface for exercising movement between a flexed position and an extended position, the user being oriented in a downwardly-facing condition relative to the supporting surface;

(c) said inclined surface defining a recess therein for protecting the groin area of the user during exercising;

(d) a declined surface supported by the base, and defining a relatively short, steep decline extending downwardly at an angle from the front edge of said inclined surface towards the supporting surface, said declined surface engaging a lower portion of the upper body of the user when in the flexed position; and the base, inclined surface, and declined surface being integrally formed together from a unitary, solid structure; and (e) stabilizer means connected to a back end of the inclined surface of the exercise device for engaging and holding the legs of the user against the inclined surface when exercising.

2. An exercise device according to claim 1, wherein said stabilizer means comprises a stabilizer bar for engaging the back of the legs of the user to hold the legs against the inclined surface of the exercise device.

3. An exercise device according to claim 2, wherein said stabilizer means further comprises an adjustable strap for interconnecting the stabilizer bar and the exercise device, said strap being lengthened or shortened by the user for adjusting the location of the stabilizer bar relative to the inclined surface to accommodate the height of the particular user.

4. An exercise device according to claim 3, and including an attachment cup located in an opening formed in a back end of the exercise device, said attachment cup including a shaft connected to opposing walls of said cup for securing the adjustable strap of said stabilizer means to the exercise device.

5. An exercise device according to claim 1, wherein said stabilizer means comprises a nylon belt for extending around and holding the legs of the user against the inclined surface of the exercise device.

6. An exercise device according to claim 1, and including a protective pad located adjacent to the recess for cushioning the groin area of the user during exercising.

7. An exercise device according to claim 1, wherein the solid structure defining the base, inclined surface, and declined surface is constructed of a light-weight, resilient foam material.

8. An exercise device according to claim 7, wherein said foam material comprises polyethylene.

9. An exercise device according to claim 7, wherein said foam material comprises polystyrene.

* * * * *